US005489344A

United States Patent [19]

Martin et al.

[11] Patent Number: 5,489,344

[45] Date of Patent: Feb. 6, 1996

[54] PASSIVATION OF CARBON STEEL USING ENCAPSULATED OXYGEN

[75] Inventors: Donald T. Martin, Louisville; Larry D. Paul, North Canton, both of Ohio; Neil N. Carpenter, Katy, Tex.

[73] Assignee: The Babcock & Wilcox Company, New Orleans, La.

[21] Appl. No.: 296,078

[22] Filed: Aug. 25, 1994

Related U.S. Application Data

[63] Continuation of Ser. No. 968,601, Oct. 29, 1992, abandoned.

[51] Int. Cl.[6] ..... C23C 8/10

[52] U.S. Cl. ..... 148/284; 148/287; 428/472.2

[58] Field of Search ..... 148/284, 287; 428/472.2

[56] References Cited

U.S. PATENT DOCUMENTS

| | | | |
|---|---|---|---|
| 510,318 | 12/1893 | Bertrand | 148/287 |
| 4,636,266 | 1/1987 | Asay | 148/240 |

FOREIGN PATENT DOCUMENTS

| | | |
|---|---|---|
| 0512113 | 11/1992 | European Pat. Off. . |
| 2642438 | 3/1990 | France . |
| 3614444 | 1/1987 | Germany . |
| 9105071 | 4/1991 | WIPO . |

OTHER PUBLICATIONS

Rong–di, et al. "Experimental Investigation of the Compatability of Carbon Steel and Water in Heat Pipe", 5th International Heat Pipe Conference, May, 1984, p. 34.

*Metals Handbook* (8th Edition); vol. 8, Metallography, Structures and Phase Diagrams; American Society of Metals, 1973; p. 304.

Kubaschewski and Hopkins, *Oxidation of Metals and Alloys* (Second Edition); Academic Press, Inc., 1962; pp. 108–114.

J. Schwartz, "Performance Map of the Water Heat Pipe and the Phenomenon of Noncondensible Gas Generation", Paper 69–HT–15, ASME, New York, N.Y. 1969.

K. T. Feldman, Jr. and D. D. Kenney, "The Compatibility of Mild Carbon Steel and Water in a Heat Pipe Application," Heat Recovery Systems, vol. 1, pp. 299–307, 1981.

Zho Rong–di, Zhu Yu–hua, and Liu De–chai, "Experimental Investigation of the Compatibility of Carbon Steel and Water in Heat Pipe," 5th International Heat Pipe Conference, May, 1984.

I. Honda, T. Iimura, and H. Shimoda, "A Study on Corrosion Phenomena in Water–Steel Heat Pipes," pp. 43–52, 5th International Heat Pipe Conference, May, 1984.

D. Heine, M. Groll, and O. Brost, "Formation of Passive Layers on Boiler Steel and Stainless Steel Used As Structure Materials in Water Heat Pipes," pp. 217–219, 6th International Heat Pipe Conf. May, 1987.

I. Novotna, J. Nassler, and M. Zelko, "Contribution to Compatibility of Steel–Water Heat Pipes," pp. 319–327, 3rd International Heat Pipe Symposium, Sep., 1988.

*Primary Examiner*—David A. Simmons
*Assistant Examiner*—Robert R. Koehler
*Attorney, Agent, or Firm*—Daniel S. Kalka; Robert J. Edwards

[57] ABSTRACT

A protective passive oxide layer is formed on the inner surfaces of metal heat pipes or tubes including their end caps, welds and accompanying hardware through the use of an oxygen encapsulation method. After cleaning the tube and its accompanying parts, the tube is reassembled and existing gases within the tube are removed thereby creating a vacuum inside the tube. The tube is then filled with pure oxygen and sealed. After the oxygen is sealed within the tube, the sealed tube is heated thereby forming a passive oxide layer, such as magnetite ($Fe_3O_4$) on the inner surface of the tube.

7 Claims, 2 Drawing Sheets

PASSIVATION OF CARBON STEEL USING ENCAPSULATED OXYGEN

This is a continuation of application Ser. No. 07/968,601 filed Oct. 29, 1992 now abandoned.

BACKGROUND OF THE INVENTION

1. Field of the Invention

The present invention relates in general to reducing the formation of gases within heat pipes and in particular to a new and useful method for providing a passive oxide layer on the inner surface of heat pipes for decreasing hydrogen generation rates.

2. Description of the Related Art

The use of heat pipes or heat tubes is common in the power generation and chemical process industries. The use of heat pipes has proved to be very efficient at transferring heat between fluids while keeping the fluids from mixing together. Due to the continued use of the heat pipes in the heat transfer processes, corrosion on the interior surfaces of the heat pipes occur, resulting in the formation of incondensible gases such as hydrogen. Because the gases are incondensible, they tend to build up within the heat pipe and reduce the heat pipe's ability to transfer heat thereby decreasing the efficiency and performance.

It has been found that by providing an oxide layer on the interior surface of the heat pipes, the generation rates of the incondensible gases, such as hydrogen, decrease. The hydrogen production is directly related to the formation of a passive oxide layer such as magnetite ($Fe_3O_4$) which is formed when carbon steel is exposed to high temperature deaerated water. The reaction responsible for hydrogen generation in water-carbon steel heat pipes is summarized by the equation:

$$3Fe+4H_2O \rightarrow Fe_3O_4+4H_2$$

Because incondensible hydrogen gas generation rates decrease as a passive layer is developed on the interior surface of a heat pipe, a "burn-in" method is used for treating and conditioning fresh carbon steel/water heat pipes. The "burn-in" process is usually conducted using high pressure water through the heat pipes at around 419° F. to 572° F. This "burn-in" process is very time consuming and can take as long as 160 hours.

Other treatments such as steam, gun blueing, and hydrogen peroxide have been used to form a passive oxide layer on the interior surface of the heat pipes. Steam oxidation typically is applied at 890° F. to 1060° F. and requires a high pressure steam source. Gun blueing involves caustic chemicals and hydrogen peroxide is not effective at creating a passive surface oxide layer on carbon steel.

Although several passivation processes exist for providing a passive oxide layer on the interior surface of carbon steel heat pipes, there is no known process which is both economical and can be performed in a short amount of time.

SUMMARY OF THE INVENTION

The present invention provides a method for forming a protective magnetite oxide layer ($Fe_3O_4$) on the interior surface of a heat pipe. The passive magnetite layer formed by the present invention is nearly identical to the "burn-in" methods wherein a carbon steel heat pipe is exposed to hot water for long periods of time. The present invention utilizes an oxygen encapsulation method for producing a passive oxide layer on the inner surface of the heat pipe wherein, a passive oxide layer is formed by encapsulating pure oxygen within the heat pipe.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1A:
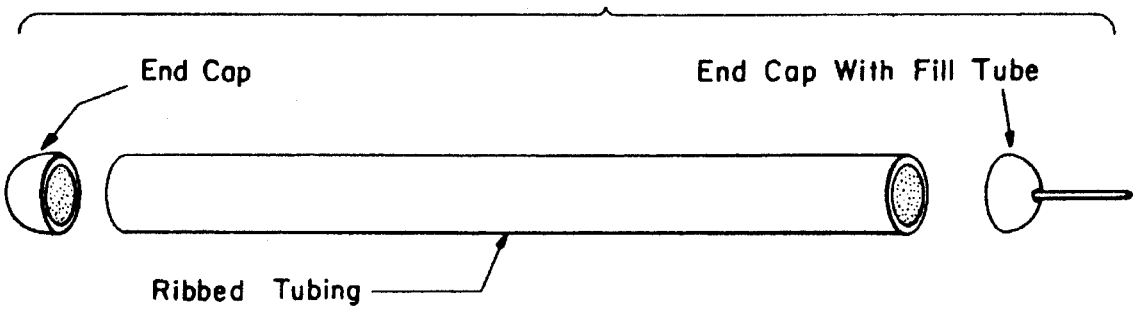
FIGS. 1A–D are a schematic diagram illustrating the encapsulated oxygen passivation method according to the present invention.
Figure 1B:
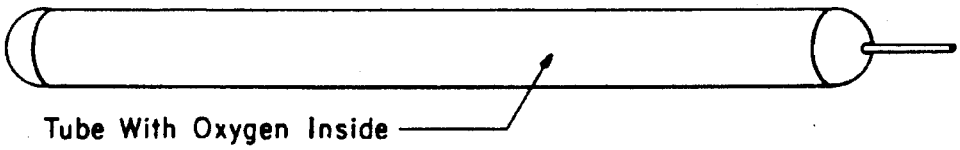
Figure 1C:
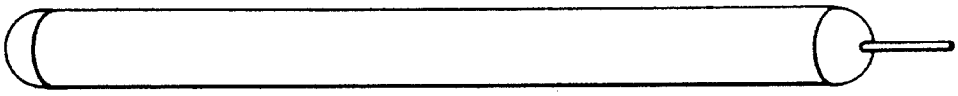
Figure 1D:
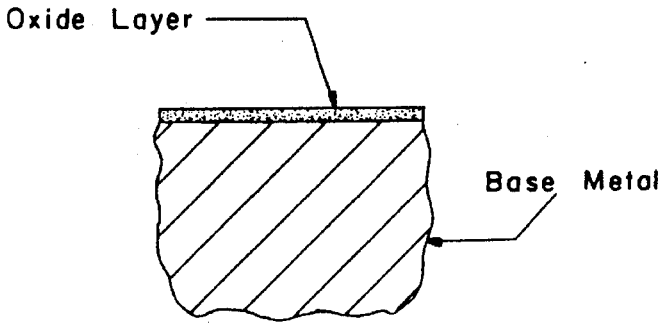
Figure 2:
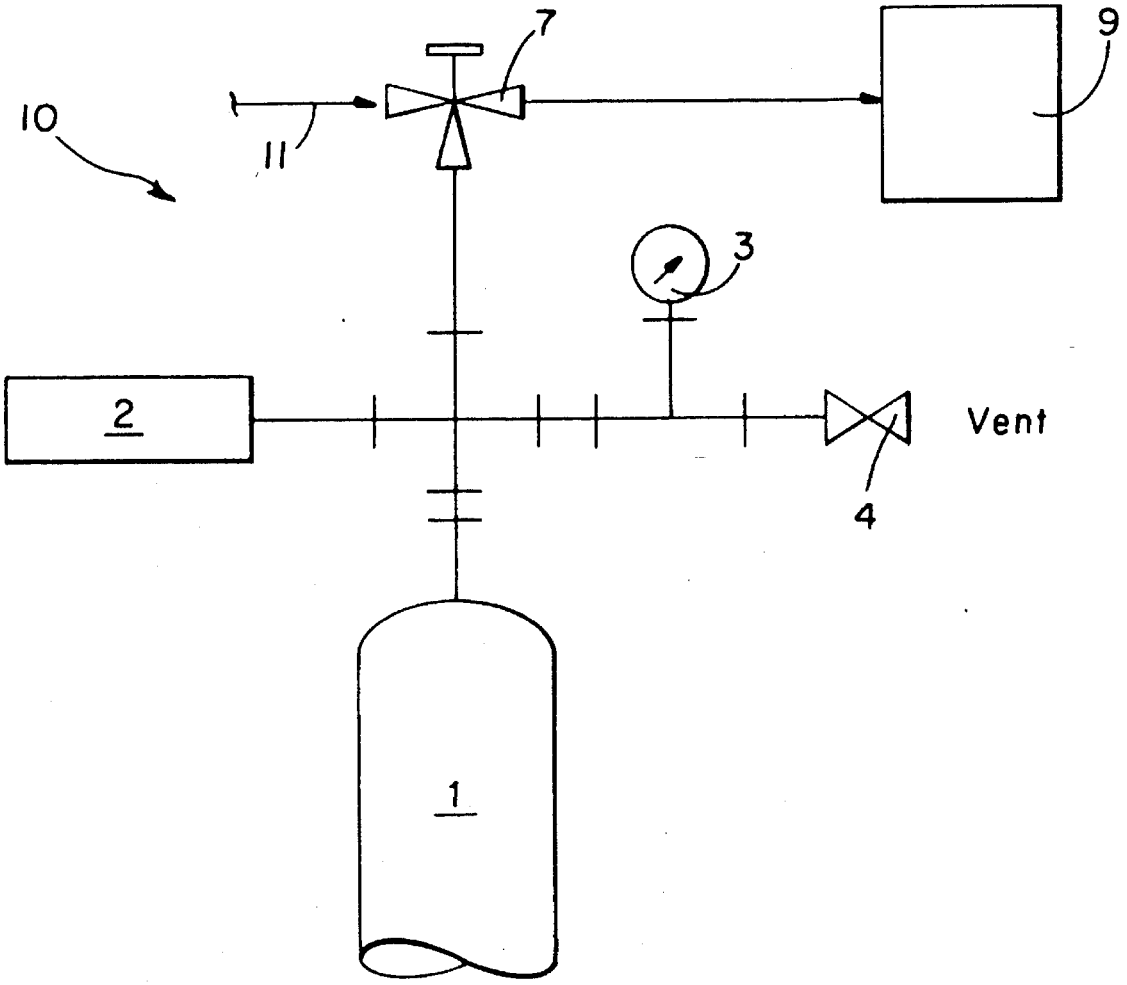
FIG. 2 is a schematic diagram of a valve and gauge assembly for evacuation and oxygen back-fill according to the present invention.

Referring to FIGS. 1 and 2 the present invention embodied therein comprises an encapsulated oxygen passivation process wherein a heat pipe 1 or tube is cleaned in order to remove oils or other substance that could possibly react with oxygen 11 during the passivation treatment. End caps and other associated hardware with the pipe 1 are also cleaned. After cleaning the heat pipe 1 is then assembled for treatment by the passivation process according to the present invention.

The passivation process comprises connecting the heat pipe 1 to a manifold, generally designated 10, containing a vacuum pump 9, a source of oxygen gas 11, a pressure gage 3, a vacuum gage 2, and a vent valve 4.

Through the use of the manifold 10 and its associated components, the heat pipe 1 is evacuated by the vacuum pump 9 in order to remove air and other undesirable gases from the heat pipe 1. Other suitable connectors may be employed such as quick connect fittings. It is preferable to evacuate to a pressure less than 1,000 microns of Hg.

After evacuation of the heat pipe 1, the heat pipe 1 is isolated from the vacuum pump 9 and backfilled with oxygen 11 under a slight positive pressure preferably 1 to 10 pounds per inch square gauge, PSIG. After the heat pipe 1 is back-filled with oxygen 11, the heat pipe 1 is then isolated from the oxygen 11 and the manifold assembly 10 is then removed and the heat pipe 1 is quickly sealed in order to prevent the escape of the oxygen 11 encapsulated within the heat pipe 1.

After sealing the heat pipe 1 and encapsulating the oxygen 11, the heat pipe 1 is then subjected to a heat treatment at a preferable temperature not to exceed 1,050° F. After heat treatment, the heat pipe 1 is then evacuated and filled with a working fluid i.e. water for being put into service.

The oxygen encapsulation method utilized by the present invention for passivating heat pipes or tubes has the following advantages over other known methods of applying passive surface layers. The oxide formed with the oxygen encapsulation method is the same type as that formed during operation of the heat pipe and therefore provides optimum protective ability. Also, the oxide layer can be formed over the entire inside surface of the heat pipe tube, including welds, end caps, and fill tube.

The present invention ensures that there are no chemicals that must be removed later or that can interfere with the operation of the heat pipe and provides a much thicker oxide layer than other low temperature techniques.

High pressures are not involved, as found when using steam or water. This ensures the structural integrity of the heat pipe and simplifies the process. Because only the inside surface of the heat pipe is passivated, the oxidizing atmosphere does not contact the heat treating furnace preventing damage to the furnace.

By encapsulating pure oxygen inside the tube, a large amount of oxygen is available for reaction to form a protective magnetite scale. If the tube were not encapsulated, the gas would expand and be forced out of the tubes.

The use of air, instead of oxygen, would also make less oxygen available for reaction with the heat pipe tubes resulting in a thinner and therefore less protective oxide layer.

The present invention is of relatively low cost and can be accomplished with standard equipment that is used in the fabrication of heat pipes.

While a specific embodiment of the invention has been shown and described in detail to illustrate the application of the principles of the invention, it will be understood that the invention may be embodied otherwise without departing from such principles.

What is claimed is:

1. A method of forming a passive magnetite oxide layer on an inner surface of an iron base metal heat pipe for reducing corrosion and thereby reduce the amount of incondensible gas formation within the heat pipe, the method comprising the steps of:

assembling end caps on an iron base metal tube, one of said end caps having a fill tube;

removing existing gases from the iron base metal tube through the fill tube thereby creating a vacuum in the iron base metal tube;

filling the iron base metal tube with oxygen gas through the fill tube;

sealing the oxygen gas within the iron base metal tube;

heating the sealed iron base metal tube to a temperature less than 1050° F. to form a passive magnetite oxide layer on the inner surface of the iron base metal tube; and filling the iron base metal tube with a working fluid to make a heat pipe which has a passive magnetite oxide layer on an inner surface that reduces corrosion and an amount of incondensible gas formation therein.

2. The method according to claim 1, wherein the iron base metal tube and the end caps are cleaned prior to the removing, filling and sealing steps.

3. The method according to claim 1, wherein a vacuum pump reducing the pressure to less than 1,000 microns of Hg is used to remove existing gases from the iron base metal tube.

4. The method according to claim 1, wherein the iron base metal tube is filled with oxygen to a pressure of 1 to 10 pounds per square inch gauge.

5. The method according to claim 1, wherein an oxide layer is formed over the inner surface of the iron base metal tube and the end caps.

6. The method according to claim 1, wherein oxygen is provided from a pure oxygen source.

7. The method according to claim 1, wherein remaining gases are evacuated from the iron base metal tube after the passive oxide layer is formed.

* * * * *